United States Patent [19]

Silvestri

[11] Patent Number: 4,729,695

[45] Date of Patent: Mar. 8, 1988

[54] PROCESS FOR THE INSTALLATION OF THE ENBLOC SUPERSTRUCTURE OF AN OFFSHORE PLATFORM, AND EQUIPMENT FOR CARRYING IT PRACTICALLY

[75] Inventor: Antonio Silvestri, San Donato Milanese, Italy

[73] Assignee: Saipem, S.p.A., Milan, Italy

[21] Appl. No.: 837,259

[22] Filed: Mar. 7, 1986

[30] Foreign Application Priority Data

Jun. 19, 1985 [IT] Italy ..... 21211 A/85

[51] Int. Cl.[4] ..... E02B 17/08

[52] U.S. Cl. ..... 405/204; 405/196; 405/203; 405/209

[58] Field of Search ..... 405/203, 204, 209, 195, 405/196, 205, 208; 114/264, 265

[56] References Cited

U.S. PATENT DOCUMENTS

| | | | |
|---|---|---|---|
| 2,907,172 | 10/1959 | Crake | 405/209 |
| 3,078,680 | 2/1963 | Wepsala | 405/209 |
| 4,249,618 | 2/1981 | Lany | 405/204 |
| 4,252,469 | 2/1981 | Blight et al. | 405/203 |
| 4,487,526 | 12/1984 | Struve et al. | 405/203 |
| 4,607,982 | 8/1986 | Brasted et al. | 405/204 |
| 4,655,641 | 4/1987 | Weyler | 405/204 |

FOREIGN PATENT DOCUMENTS

81/0039590 11/1981 World Int. Prop. O. ..... 405/203

*Primary Examiner*—Dennis L. Taylor

*Attorney, Agent, or Firm*—Morgan & Finnegan

[57] ABSTRACT

A process and apparatus for installing the enbloc superstructure of an offshore platform on the fixed legs emerging from water of the lower structure or jacket including loading the whole superstructure on a vertically movable support platform provided on the deck of a semisubmersible raft or barge, completely submerging the raft in the vicinity of the jacket, the stability being maintained by vertical buoyancy tanks on the raft deck, and lifting the support platform and the superstructure by activating related hydraulic lift cylinders, to a height higher than that of the protruding ends of the jacket leg, independently from wave-motion of sea. Subsequently, cylindrical lift pillars slide, by means of hydropneumatic jacks, within tubular columns provided in the superstructure until the conical ends of the pillars enter corresponding seats in the jacket legs and, during a moment of smooth sea, the superstructure is lifted to the desired height using the hydropneumatic jacks, while at the same time, the support platform is rapidly lowered, and the raft is ballasted.

6 Claims, 16 Drawing Figures

4
1
3
5
5
23
23
10
18
2
7
8
10
20
34
34
19
17
11
13
9
16
16
17
15
17

17
3
1
17
16
15
23
9
16
19
2
10
5
5
10
21
20
17
4
4
23
18
16
16
19
15
17

PROCESS FOR THE INSTALLATION OF THE ENBLOC SUPERSTRUCTURE OF AN OFFSHORE PLATFORM, AND EQUIPMENT FOR CARRYING IT PRACTICALLY

BACKGROUND OF THE INVENTION

The present invention relates to a new process which, by allowing the installation of the structures constituting the deck supporting beams, the drilling and production equipment, the living quarters, i.e., the whole complex constituting the complete superstructure of an offshore platform, in enbloc form and with one single positioning operation, allows notable cost and time savings in the laying of platforms in the high seas, as well as providing platforms which are more rational, of immediate functionality, and better optimized and hence less heavy.

It is known that in the installation of an offshore platform, the most critical step is that of mating or depositing the upper structure or deck of the platform which, while being supported by a suitable vessel or transportation raft or barge, is unavoidably subjected to the wave motion of sea, onto the fixed legs, emerging from water, of the platform's lower structure or jacket, which rests on the sea bottom. During this stage, it is desirable to achieve the transferral of the load of the platform's upper structure from barge deck to jacket legs as rapidly as possible to avoid the harmful effects of wave-motion which could damage both the structure and the vessel or raft used to carry the structure.

From the present art a process is already known for installing a platform's deck on jacket legs. According to the known process, the deck, supported by the floating hull of a barge or raft, is positioned by the barge or raft amid jacket legs, and then lowered onto the jacket legs and liberated from the barge or transportation raft by suitably submerging the barge or raft.

Such a process has, however, a number of drawbacks. The main drawback is the very long time required for flooding the ballast tanks of raft or barge, to submerge it. This renders the mating operation very difficult, in that it requires a smooth sea for long time periods since the barge is very sensitive to wave motion. Such a need makes the use of this known process impractical in those areas wherein wave motion is always present. Additionally, since raft submerging inertia does not accomplish the setting down operation as perfectly controlled and prefixed as necessary, no precision can be obtained in the mating operation, which results in many attempts being required and hence considerable efforts and time. Moreover, during these repeated attempts, lasting in time, both the raft or barge and platform superstructure or deck shall suffer many impacts, due to the wave motion, against jacket legs, with consequent possibility of considerable damages to the structures. Finally, since the deck must always be kept at a level higher than the protruding legs of the jacket legs, independently from sea wave motion, a large frame is used to support the deck on the raft, requiring big and expensive transportation rafts, with consequent navigation difficulties.

A further drawback of this known process is that both the very deck, that is to say the structure constituting the platform deck bearing beams, and the other parts constituting the complete superstructure of off shore platform must be transported and installed as modules, resulting in an increase in the cost of installation and the amount of equipment required for installation, as well as the need of further transportation and naval lifting means.

OBJECTS OF THE INVENTION

The purpose of the present invention is precisely to obviate these drawbacks, and to provide a process for the installation of the superstructure of an offshore platform which allows cost and time savings, does not require big transportation rafts or barges, is practically unaffected by sea wave motions, and therefor allows noticeable precision and softness in the mating operation, and above all allows the whole complete superstructure of an offshore platform to be transported in enbloc form. The advantages of transporting the whole superstructure in enbloc form are indeed evident and include: a considerable reduction in offshore installation times; nearly complete elimination of a hook-up operation or completion works; that is, the linking of the various superstructure's modules to each other; a reduction of costs of piping materials and of materials required for electrical power and instrumentation cable lay up; an improvement of plant lay-out, i.e., of the location of various plant's components which, by being designed as one single block, shall have an optimum location; and the possibility of accomplishing most of the commissioning operations directly on dry-land, before offshore transportation, with consequent notable reduction of time required for project completion.

SUMMARY OF THE INVENTION

These objectives are achieved by adopting a semi-submersible raft or barge, made stable during the submersion by vertical buoyancy tanks installed on the deck. A "movable platform" is also installed on the deck having a large-dimension rectangular slab which must support the entire offshore platform superstructure monoblock and shock absorbers suitably positioned to absorb the unavoidable shocks due to the movements in the horizontal plane of the raft when subjected to wave-motion during the mating stage. These shock absorbers, which can be made of packed elastomers of the type used for ship's docking, or alternatively, made of cushions of elastic material filled with water or with compressed air, can be rendered ineffective during the navigation. The slab or movable platform is moreover rendered vertically sliding with the aid of a considerable number of hydraulic cylinders vertically installed in raft's hull, whose pistons shall preferably have a 4–5 meter stroke and a total thrust equal to at least 1.5 times the load to be supported. The moveable platform is also vertically guided during the lifting and lowering stages by a set of vertical beams fastened on to the slab in positions alternating with and having spacings corresponding to the spacing of the hydraulic cylinders. These beams slide within vertical precision guides also incorporated within the hull of raft or barge.

On the other side of the offshore platform deck or superstructure, vertical tubular columns are provided which correspond in orientation with the axes of the protruding legs of the underlying jacket. Within the tubular columns are slidable cylindrical pillars which, by inserting their end portions, of conical shape to facilitate the self-centering, into the corresponding prearranged seats in the jacket legs, shall constitute the load bearing pillars of the whole superstructure monobloc. These sliding pillars are thrusted downwardly from the upper section of the columns by a set of hydropneumatic jacks inserted inside the columns, and linked to two superimposed clamping rings which, by pneumatic expansion, are alternatively clamped against the wall of the columns.

The pistons of the double-effect jacks shall have a stroke of 1–2 meters. It is evident that when the sliding pillars rest on the jacket legs, continuing action of the jacks, shall cause a lifting of the whole superstructure which can thus reach the desired height.

By the combined intervention of such equipment it is indeed possible it to obtain an easy transportation, as well as a quick transferral of the superstructure monobloc of an offshore platform from the deck of raft or barge on to the jacket legs.

The "movable platform" allows the structure supported by it to be lifted, as needed, up to a height greater than that of the protruding jacket legs only when the raft has arrived in the vicinity of the legs. The platform also allows the transport of the structure by sea with the structure practically resting on raft's deck and hence with a very low center of mass, facilitating the navigation thereof. The platform, therefore, allows the enbloc transportation of the whole superstructure of an offshore platform previously manufactured and assembled on dryland and then loaded onto the raft. Furthermore, the possibility of assembling the superstructure on dry-land allows the production of a superstructure complete block which is notably compact and hence has a very low center of mass. This provides the further advantages, besides facilitating the transportation by sea, of also facilitating the building of the superstructure on dry-land by rendering the structure being assembled more easily accessible by yard's personnel and operating equipment (cranes), as well as facilitating the loading of the structure onto the raft.

By submerging the raft or barge stabilized by the vertical buoyancy tanks in the vicinity of the jacket legs, the raft is rendered practically insensitive to sea wave motion, which considerably facilitates not only the operations of approaching and subsequent centering of the raft amid the jacket legs, but also the final adjusting of the raft, so that the axes of the jacket legs are lined up with those of the corresponding structure's sliding pillars, and hence, ultimately, facilitates the mating operation.

This mating operation is further facilitated and simplified by the sliding cylindrical pillars of the superstructure which, by being inserted inside the corresponding seats prearranged in the jacket legs, center the superstructure relative to the jacket. In case of noticeable wave motion, these pillars remain idle inside their vertical columns, liberating the jack pneumatic clamping rings, until when, by taking advantage of a calm moment in the sea, the transferral of superstructure load from the raft to the jacket shall be started, making all jacks act at the same time.

Summarizing, the process of the present invention is for the installation of the superstructure of an offshore platform on the fixed legs which emerge from the water of the lower structure or jacket of the platform, which rests on sea bottom. The process of the present invention generally includes among others, the step of transporting the structure to be installed to the vicinity of the lower structure or jacket by a raft or barge, the step of piloting and making the raft or barge enter amid the jacket legs by means of tugs and of cables or lines, as well as the step of effecting the final adjustment of the raft position, to make possible the mating between the structure to be installed and the jacket legs. More specifically, the installation process according to the present invention also includes the initial step of loading the monoblock of the whole superstructure of an offshore platform previously assembled on dry-land on a vertically movable supporting platform provided on the raft deck. Once the superstructure is transported by barge to the vicinity of the lower structure, the process of the present invention includes the steps of completely submerging the raft stabilized by vertical buoyancy tanks installed on the deck of the raft and lifting the movable supporting platform and, therefore, the superstructure to a height higher than that of jacket legs' protruding ends independently from sea wave motion, by activating related lifting hydraulic cylinders. Then, after having carried out the final adjustment of the raft position, the subsequent steps of activating the shock dampeners interposed between the supporting platform and the superstructure, and sliding the lifting cylindrical pillars within the respective tubular columns provided in the structure of the deck of the monobloc superstructure, to insert the conical end portions of the pillars into, and making they rest inside the corresponding seats provided in the underlying jacket legs. Hydropneumatic jacks which are inserted inside the columns slide the pillars and are linked to two superimposed clamping rings which, by pneumatic expansion, are alternatively clamped against the inner wall of the columns. In the moment of smooth sea, the process involves the contemporaneous steps of lifting the superstructure up to the desired height relative to the jacket legs, rapidly lowering down the movable support platform and rapidly flooding the ballast tanks of the raft or barge to compensate for the superstructure weight transferred from the raft to the jacket. Finally, the process of the present invention involves the steps of welding the pillars to the respective jacket legs and to the respective tubular columns, retracting the hydropneumatic jacks from the pillars by de-energizing the pneumatic clamping rings, removing the jacks from the superstructure and moving the raft out from the jacket legs.

According to a preferred embodiment of the present invention, the vertically movable support platform is constituted by a rectangular slab horizontally fastened to the end of the Pistons of a numerous set of hydraulic cylinders positioned parallel to each other, and vertically fixed in the hull of the raft or barge. The slab is also provided with a set of vertical beams which, fastened to its lower surface in positions alternating with the pillars, are inserted into precision vertical guides which are also incorporated and fixed in the hull of raft or barge.

Finally, to facilitate the self-centering of the sliding pillars for the lifting of the support platform inside the corresponding seats in jacket legs and above all to absorb, as required, the movements of raft or barge during the mating operation, the present invention also provides each cylindrical lift pillar which slides within a respective column with a radial clearance compensated for by inner guide elastic rings as well as, at the lower end, by a metal collar radially movable inside a circumferential guide with which the column is provided. The collar is to be welded to the positioned pillar, which is then provided with a circumferential stop shoulder to be welded to the upper edge of the seat in jacket leg. The jacket leg is provided with a flared self-centering element which can be opened and removed by remotely controlled jacks.

BRIEF DESCRIPTION OF THE DRAWINGS

The invention will be described in greater detail below by way of reference to the following drawings, in which.

DETAILED DESCRIPTIONS

Figure 1:
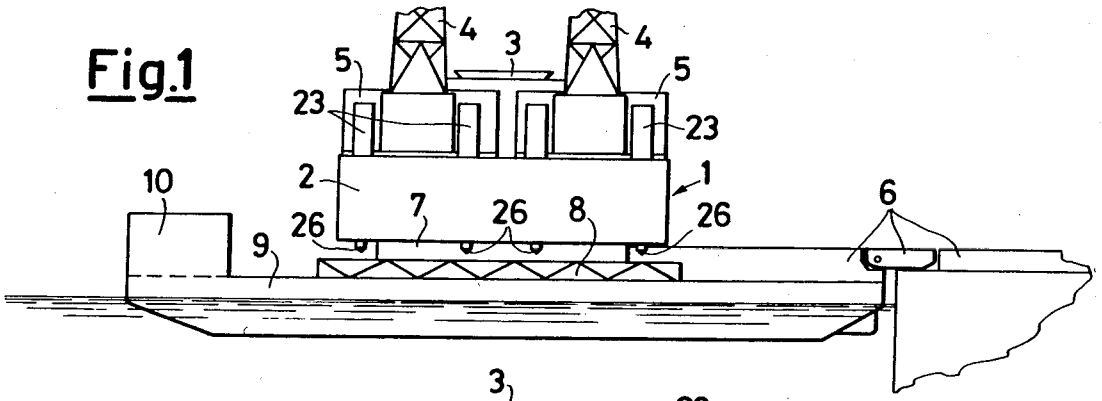
FIG. 1 is a side elevation view of the complete superstructure loaded onto a raft having the two rear vertical boyancy tanks removed.

Referring to the drawings, the enbloc superstructure of an offshore platform to be installed is generally denoted by the numeral 1, and essentially consists of a deck 2, assembled on dry-land, onto which, also on the dry-land, a heliport 3, drilling towers 4, and living quarters 5 are mounted and all necessary connections are carried out.

Figure 2:
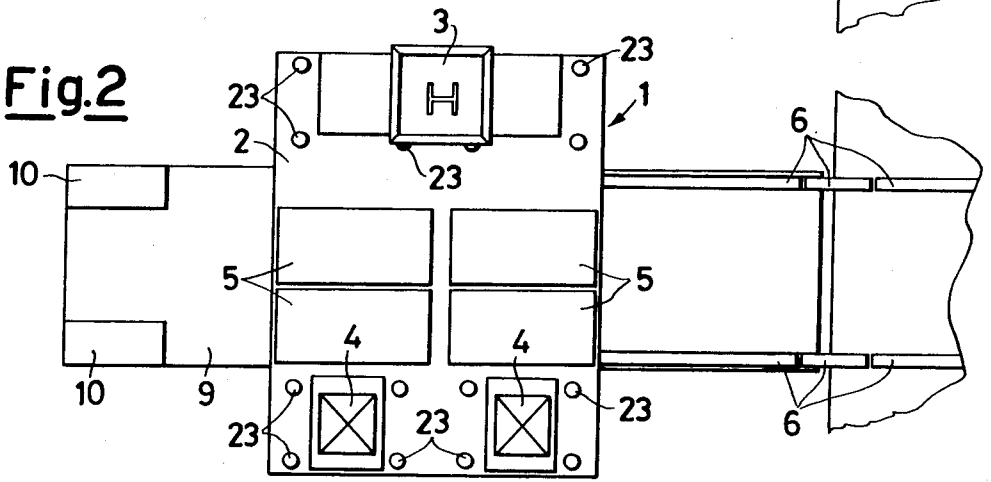
FIG. 2 is a top plan view of the complete superstructure loaded onto a raft having the two rear vertical boyancy tanks removed.

The complete superstructure block 1 is built on a two-way or four-way skidway 6 (of two-way type in FIG. 2), which then serves for the loading of the superstructure on a support platform 7. The support platform 7 is supported in turn by a backing structure 8 mounted to the deck of a semisubmersible raft or barge 9 provided with vertical buoyancy tanks 10 installed on the deck.

The support platform 7 is vertically movable and substantially consists of by a rectangular slab horizontally fastened on to the ends of pistons 11 of a numerous set of hydraulic lift cylinders 12 (see specifically FIGS. 8–11), positioned in parallel to each other, and vertically fixed inside the hull of raft 9. The slab 7 is moreover guided during its vertical motion by a set of vertical beams 13 which, being fastened on to the lower surface of the slab 7 in positions spaced relatively to the cylinders 12, are inserted inside vertical precision guides 14 which are also incorporated and fixed in the hull of raft 9.

Figure 3:
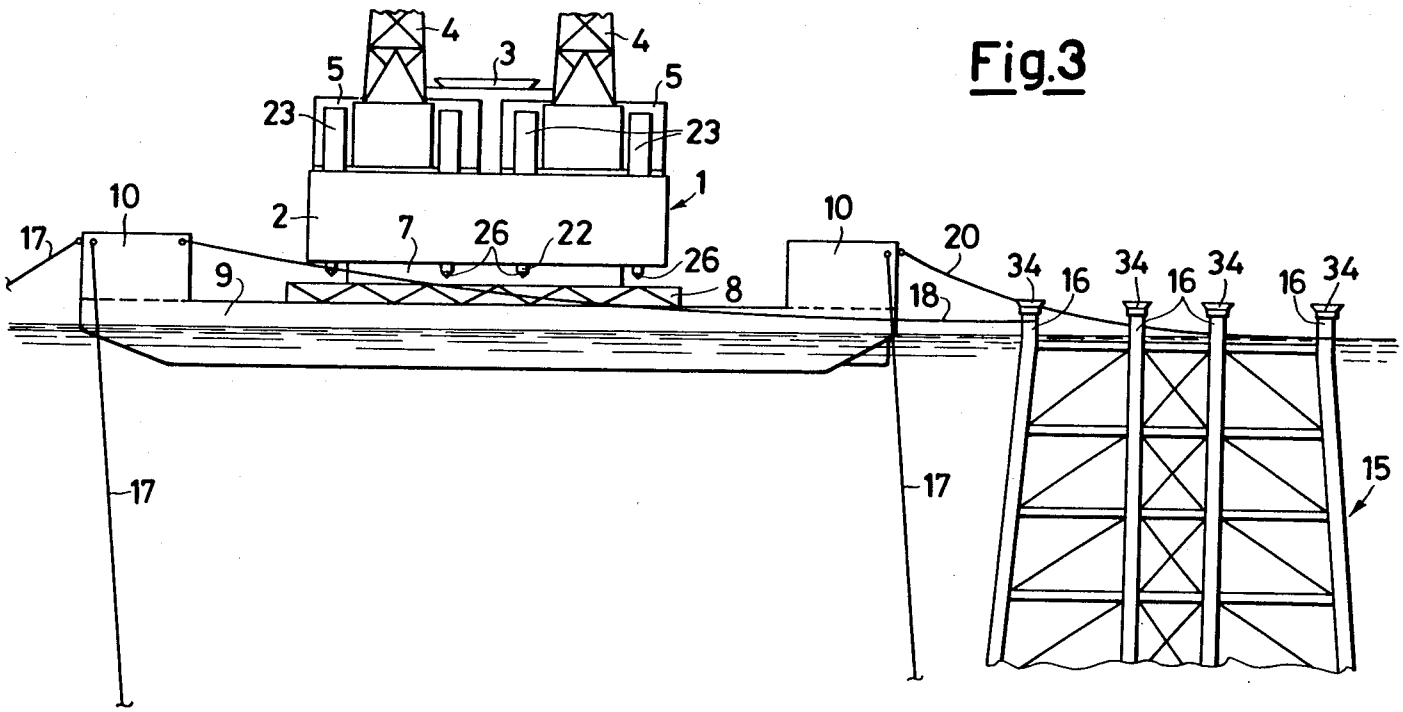
FIG. 3 is a side elevation view of the raft carrying the superstructure anchored in the vicinity of the lower structure.
Figure 4:
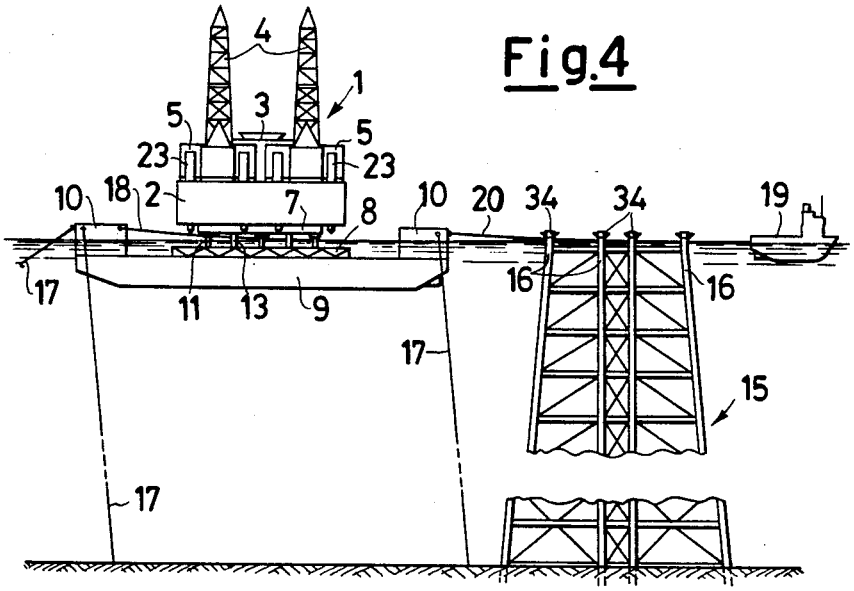
FIG. 4 is a side elevation view of the raft carrying the superstructure anchored and submerged in the vicinity of the lower structure.

After the preliminary removal of the two rear vertical buoyancy tanks 10 (see FIGS. 1 and 2), and the monobloc of the superstructure 1 has been loaded on the raft 9 and made solid with the raft by means of the usual sea-fastening structures, it is conveyed by sea to the vicinity of the lower structure or jacket 15 of the platform, whose legs protrude out from water. Once there, the raft is anchored to the sea bottom by means of ropes 17 (see FIG. 3), and linked by means of polypropylene lines 18 to apposite bitts prearranged on the legs 16 of the jacket 15. The raft is then completely submerged (see FIG. 4), and finally, after having been rendered stable by its vertical buoyancy tanks 10, enters amid the legs 16 of jacket 15, towed by tugs 19 by means of cables 20, whilst the movable support platform 7 is raised by activating the hydraulic lift cylinders 12 and consequently the superstructure monobloc 1 is lifted to a height greater than that of the protruding ends of legs 16 of jacket 15.

Figure 5:
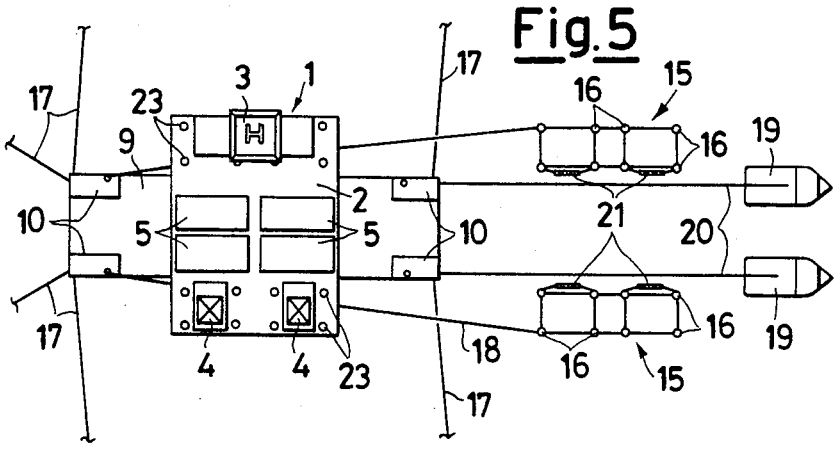
FIG. 5 is a top plan view of the raft carrying the superstructure anchored and submerged in the vicinity of the lower structure.
Figure 6:
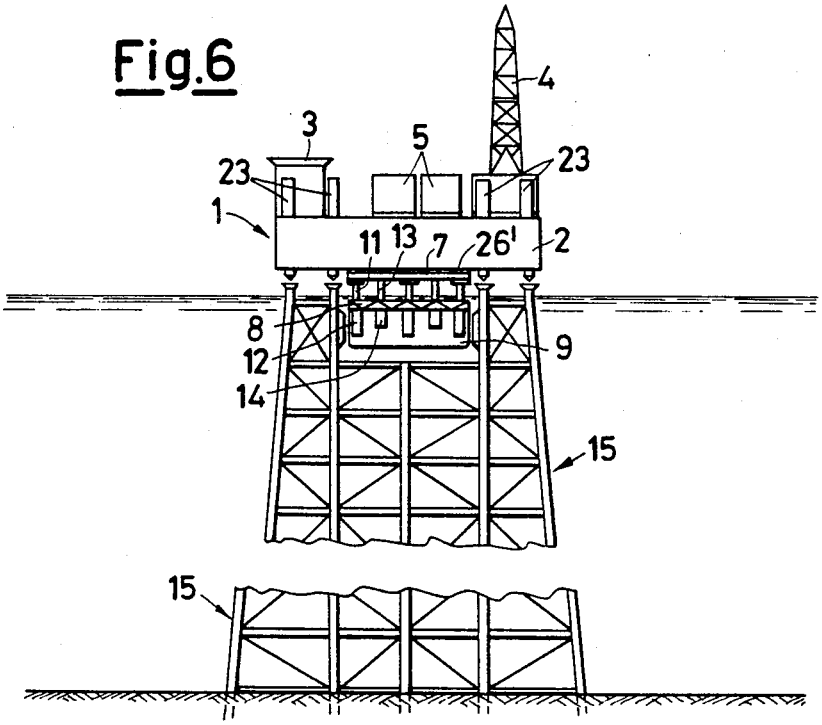
FIG. 6 is a side elevation view of the raft carrying the superstructure amid the legs of the lower structure with the moveable support platform in the raised position.
Figure 7:
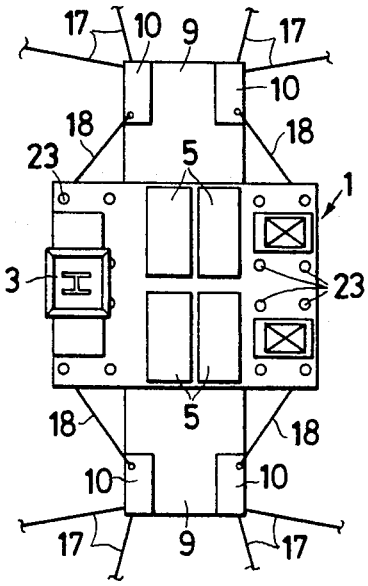
FIG. 7 is a top plan view of the raft carrying the superstructure showing the lines and cables used for the final position adjustment.
Figure 8:
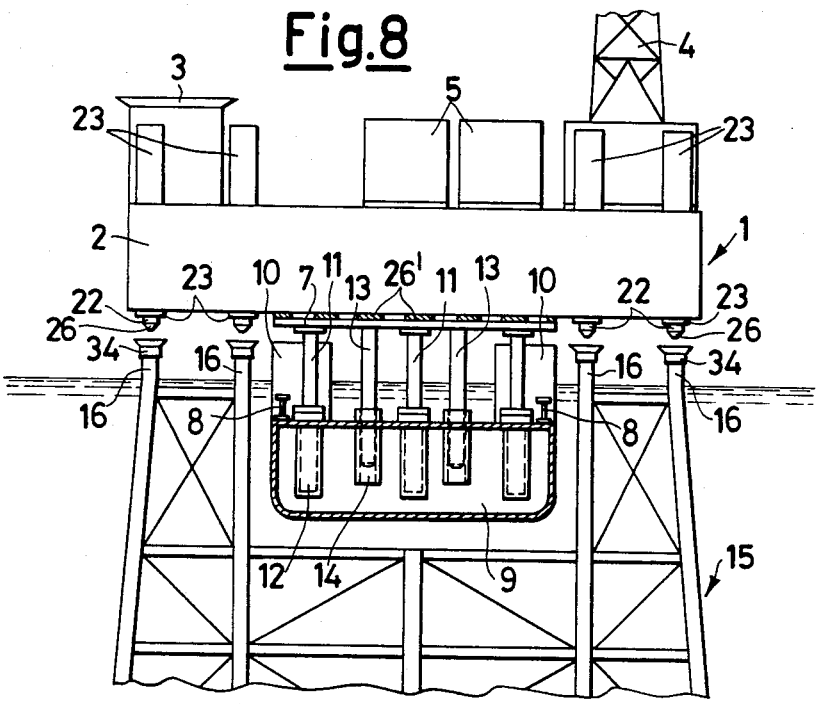
FIG. 8 is an enlarged side elevation view of the raft carrying the superstructure amid the legs of the lower structure with the movable support platform in the raised position and a portionof the raft cut away to show the internal structure thereof.
Figure 9:
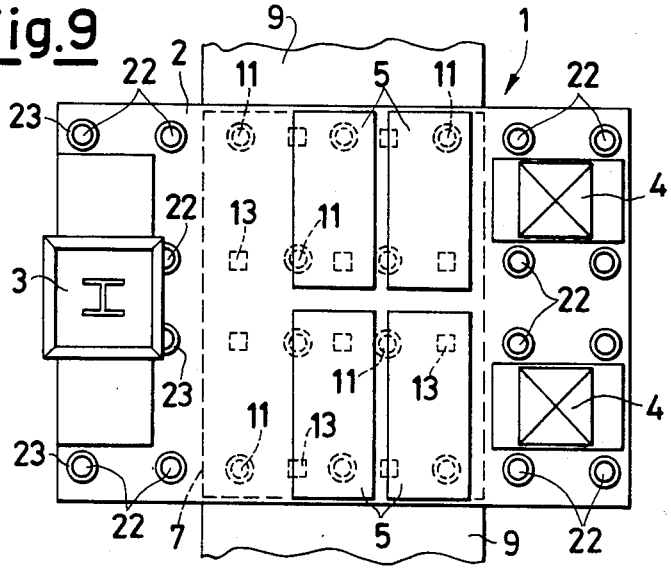
FIG. 9 is an enlarged top plan view of the raft carrying the superstructure amid the legs of the lower structure.
Figure 10:
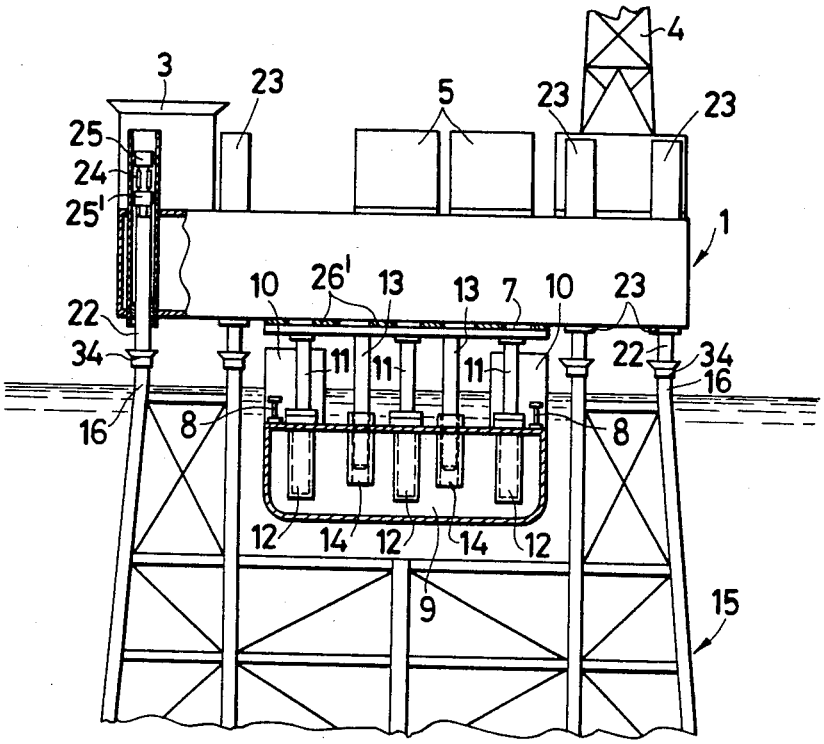
FIG. 10 is an enlarged side elevation view of the raft carrying the superstructure with the pillars lowered into the seats on the legs of the lower structure having portions of the raft and superstructure cut away to show the internal structures thereof.
Figure 11:
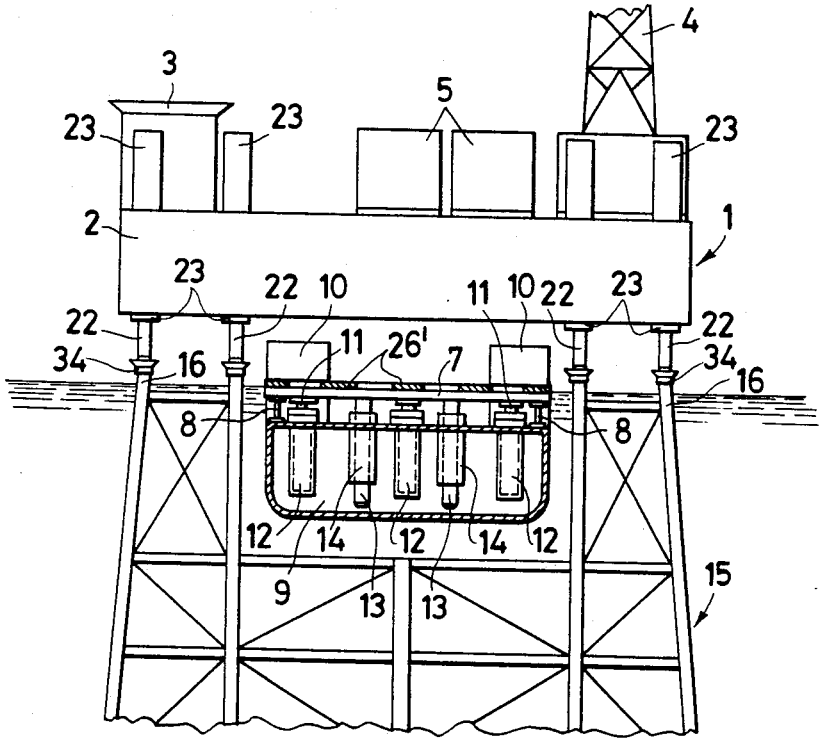
FIG. 11 is an enlarged side elevation of the raft amid the legs of lower structure with the movable support platform in its lowered position and portions of the raft cut away to show the structure thereof and the superstructure properly positioned upon the lower structure.
Figure 12:
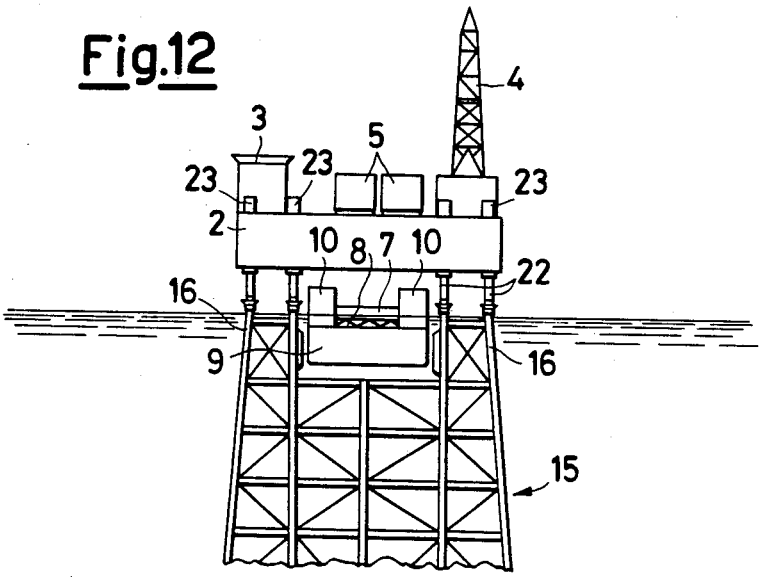
FIG. 12 is a side elevation view of the raft amid the legs of the superstructure with the moveable support platform in the lowered position and the superstructure properly positioned upon the lower structure.
Figure 16:
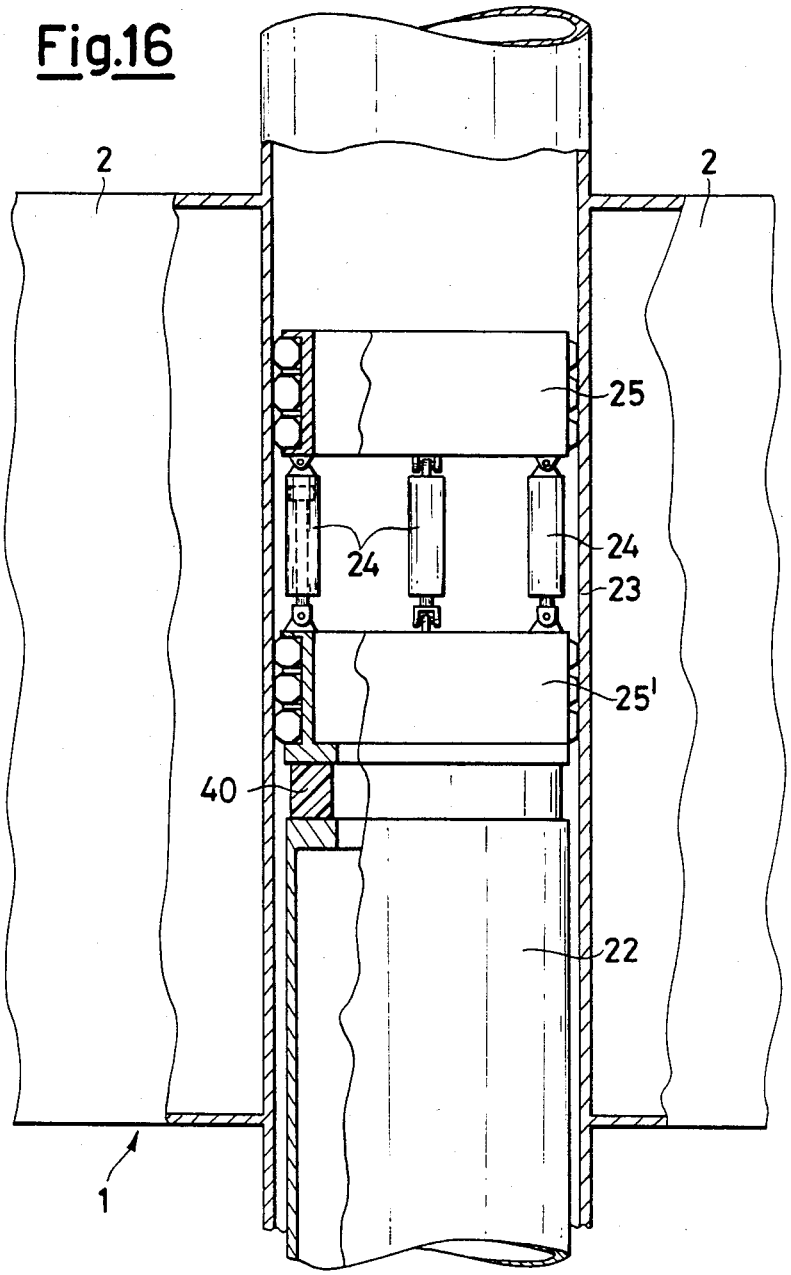
FIG. 16 is a partly sectional and enlarged view of a cylindrical lift pillar actuated by the jacks inside its own vertical tubular column.

After the raft 9 has been inserted amid the legs 16 of jacket 15, between which suitable elastic fender bars 21 are provided (see FIG. 5), the final position adjustment of the raft is carried out, by acting on the windlasses of the anchoring cables, 17, and above all by warping on polypropylene cables 18 (see FIG. 7), until the axes of the legs 16 of the jacket 16 coincide with those of a corresponding set of cylindrical pillars 22 (see specifically FIGS. 10 and 16). The pillars 22 slide vertically within tubular columns 23 fastened to the deck 2 of superstructure 1. Each lift pillar 22 is driven inside the respective column 23 by a set of hydropneumatic jacks 24 (three in FIG. 16) which, inserted inside the column 23, are linked to two superimposed clamp rings 25 and 25', which, by pneumatic expansion, are alternatively clamped against the inner wall of the column 23. Between the pillar 22 and the clamping ring 25' facing it a dampener cushion 40 is inserted.

Figure 15:
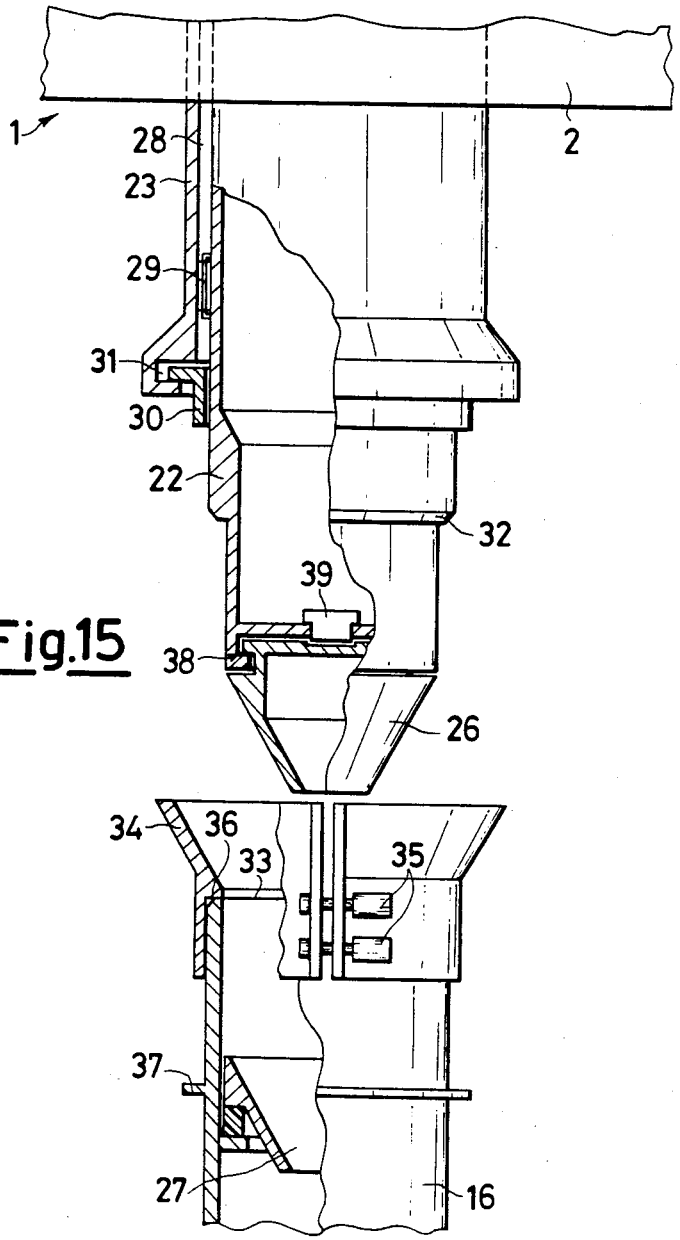
FIG. 15 is a partly sectional and enlarged view of a cylindrical lift pillar and the related seat in the jacket leg, according to the present invention.

After the final adjustment, the sea fastening structures are liberated, shock dampeners 26' interposed between the support platform 7 and structure 1 (see FIGS. 6, 8, 10, and 11) are activated,and the very mating operation is carried out, consisting of lowering down, by means of the hydropneumatic jacks 24, the lift pillars 22 to insert their conical end parts 26 into the corresponding underlying legs 16 of jacket 15 (see FIG. 10) and making the pillars 22 rest on respective seats 27 (see FIG. 15) provided in the legs.

To absorb the unavoidable movements of raft 9 and consequently of pillars 22, and hence favouring the mating operation, each cylindrical lift pillar 22 (see specifically FIG. 15) has according to the present invention, a radial clearance 28 relative to the respective column 23, which is compensated for with inner guide elastic rings 29 as well as, at the lower end, with a metal collar 30 which is radially movable inside an inner circumferential guide 31 with which the same column is provided. The guide 31 must be then welded to the pillar 22 to block it in the desired position. The pillar 22 is moreover provided with a circumferential stop shoulder 32, which must be welded to the upper edge 33 of the related leg 16 (see FIG. 15). The leg 16 is in turn provided with a flared self-centering element 34 which rests on the upper edge 33 of the leg 16, and can be opened from a remote position by means of the jacks 35 to disengage its circumferential tooth 36 from the edge 33. It is thus possible to move the self-centering element 34 down to the shoulder 37, so as to render edge 33 accessible for welding. Finally, the conical end portion 26 of the pillar 22 is supported axially movable, by means of a dovetail with clearance 38, to cooperate with a load cell 39.

Figure 13:
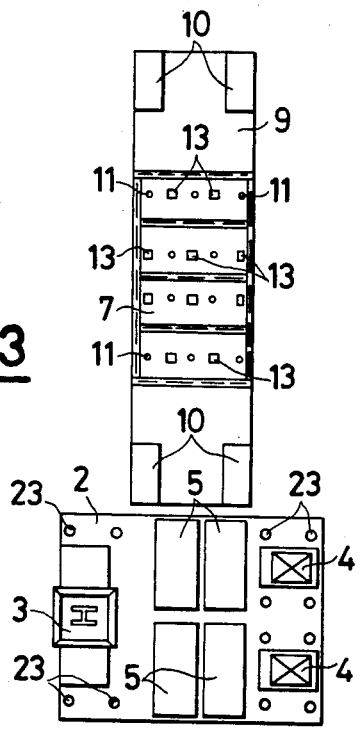
FIG. 13 is a top plan view of the superstructure properly positioned upon the lower structure and the raft in the vicinity thereof.

Then, after having verified that all pillars 22 are well resting inside their respective seats 27, and give hence the same signalling to the respective load cells 39, during a moment of smooth sea the hydropneumatic jacks 24 are activated, so as to rapidly lift the superstructure 1. At the same time, the valves for the fast flooding of the ballast tanks of the semisubmersible raft 9 are opened, and the command is given for the lowering down of the movable support platform 7 (see FIG. 11), acting on hydraulic cylinders 12. These three contemporaneous actions cause the weight of superstructure 1 to be rapidly transferred from the raft 9 to the jacket 15, thus disengaging the raft 9, and making it possible for the raft to be moved out from amid the legs 16 of the jacket 15, with a maneuver which shall be contrary to that carried out for its introduction (see FIG. 13).

In the mean time, by continued action of the jacks 24 of the pillars 22, the superstructure 1 shall be brought at the design end level.

Figure 14:
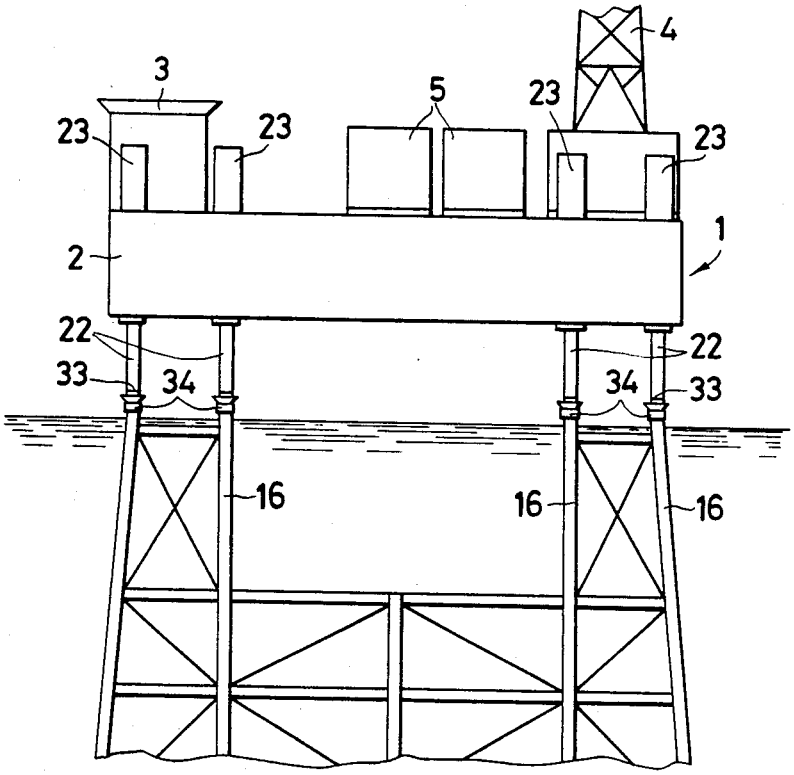
FIG. 14 is an enlarged side elevation view of the superstructure properly installed upon the lower structure.

Then after having carried out the welding of the rings 30 of columns 23 to the respective pillars 22 and of the stop shoulders 32 of the same pillars to the upper edges 33 of the related underlying legs 16 of the jacket 15, after having preliminarily moved downwards the flared self-centering elements 34, removing the hydropneumatic jacks 24 is possible (FIG. 14.).

Although particular illustrative embodiments of the present invention have been described herein with reference to the accompanying drawings, the present invention is not limited to these particular embodiments. Various changes and modifications may be made thereto by those skilled in the art without departing from the spirit or scope of the invention, which is defined by the appended claims.

I claim:

1. A process for installation of a superstructure onto a lower structure to form an offshore platform supported on a sea bottom wherein said lower structure includes a plurality of legs extending upwardly from the sea bottom and emerging from the water, the process comprising the steps of:

loading said superstructure on a vertically movable support platform having shock dampeners interposed between said platform and said superstructure provided on a semi-submersible vessel;

submerging said vessel in the vicinity of said lower structure;

raising said movable support platform such that said superstructure loaded thereon is at a height greater than said emerging ends of said legs independent from sea wave motion;

aligning said superstructure over said lower structure;

activating said shock dampeners interposed between said supporting platform and said superstructure;

contacting said superstructure to said lower structure;

transferring the weight of said superstructure from said vessel to said lower structure by contemporaneously lifting said superstructure up to a desired height relative to said legs, lowering said movable support platform and flooding ballast tanks provided on said vessel; and affixing said superstructure to said lower structure;

2. A method as in claim 1 wherein the step of contacting said superstructure to said lower structure is accomplished by cylindrical lift pillars provided on said superstructure which slide downwardly to contact said pillars with corresponding legs on said lower structure.

3. A method as in claim 2 further comprising the step of affixing said pillars to said superstructure to prevent continued sliding of said pillars after said superstructure has been lifted to said desired height.

4. A method as in claim 2 wherein the step of affixing said superstructure to said lower structure comprises welding said pillars to said legs.

5. A method as in claim 3 wherein the steps of contacting said superstructure and lifting said superstructure are accomplished by hydraulic means.

6. A method as in claim 10 further comprising the step of:

removing said hydraulic means after said superstructure is affixed to said pillars and legs.

* * * * *

UNITED STATES PATENT AND TRADEMARK OFFICE

CERTIFICATE OF CORRECTION

PATENT NO. : 4,729,695

DATED : March 8, 1988

INVENTOR(S) : Antonio Silvestri

It is certified that error appears in the above-identified patent and that said Letters Patent is hereby corrected as shown below:

In claim 6, line 1, change "10" to --5--.

Signed and Sealed this

Thirtieth Day of August, 1988

*Attest:*

DONALD J. QUIGG

*Attesting Officer*

*Commissioner of Patents and Trademarks*